United States Patent [19]

Neumann

[11] 4,411,616

[45] Oct. 25, 1983

[54] APPARATUS FOR BURNING OF FUEL GASES AND PROCESS FOR AVOIDANCE OF COMBUSTION CHAMBER OSCILLATIONS

[75] Inventor: Ernst-Georg Neumann, Wuppertal, Fed. Rep. of Germany

[73] Assignee: Didier-Werke AG, Wiesbaden, Fed. Rep. of Germany

[21] Appl. No.: 97,797

[22] Filed: Nov. 27, 1979

[30] Foreign Application Priority Data

Nov. 27, 1978 [DE] Fed. Rep. of Germany ..... 2851248

[51] Int. Cl.[3] ..... F23D 15/04

[52] U.S. Cl. ..... 431/114; 431/2; 181/229; 110/322; 110/326

[58] Field of Search ..... 431/114, 356, 350.2; 181/290, 291, 229; 248/636, 562, 566; 165/69; 188/1 B; 110/326, 322

[56] References Cited

U.S. PATENT DOCUMENTS

| | | | |
|---|---|---|---|
| 2,224,130 | 12/1940 | Arnold | 431/114 |
| 2,329,272 | 9/1943 | Jorocemon | 431/350 X |
| 3,087,532 | 4/1963 | Beach et al. | 431/114 X |
| 3,330,324 | 7/1967 | Milligan | 431/7 X |
| 3,912,248 | 10/1975 | Pickford et al. | 248/562 X |
| 4,203,195 | 5/1980 | Nakae et al. | 248/636 X |

FOREIGN PATENT DOCUMENTS

| | | | |
|---|---|---|---|
| 2048642 | 4/1972 | Fed. Rep. of Germany | 431/114 |
| 2350338 | 11/1975 | Fed. Rep. of Germany . | |
| 2500695 | 7/1976 | Fed. Rep. of Germany | 431/114 |
| 1350530 | 4/1974 | United Kingdom . | |
| 1497930 | 1/1978 | United Kingdom . | |

OTHER PUBLICATIONS

*Combustion Driven Oscillations in Industry,* Putnam; American Elsevier Publ., 1971, pp. 162–168.

*Primary Examiner*—Samuel Scott
*Assistant Examiner*—Randall L. Green
*Attorney, Agent, or Firm*—Robert E. Burns; Emmanuel J. Lobato; Bruce L. Adams

[57] ABSTRACT

Oscillation in a combustion chamber is avoided by providing in the combustion chamber an oscillatable wall which is oscillatable by oscillation occurring in the combustion chamber. The oscillatable wall may be a wall of low flexural rigidity or a flexurally rigid wall connected at its edges with a flexible coupling to adjacent rigid portions of the combustion chamber. Oscillation of the oscillatable wall is damped by being provided with a damping layer or by being connected to a mechanical or hydraulic damper.

8 Claims, 4 Drawing Figures

APPARATUS FOR BURNING OF FUEL GASES AND PROCESS FOR AVOIDANCE OF COMBUSTION CHAMBER OSCILLATIONS

FIELD OF INVENTION

This invention relates to an apparatus for the combustion of fuel gases or liquid, powdered, or lump fuels, consisting of a burner having a device for mixing fuel gas and air, a combustion chamber whose walls surround and define the space within which the fuel gas is burned, and an outlet for the burned gases, as well as a process for the avoidance of combustion-chamber oscillations.

BACKGROUND OF THE INVENTION

In apparatus for combustion, oscillations frequently take place in the combustion chamber with frequencies within the subsonic or audible ranges, which result in the disturbing of the environment by noise and may lead to damage to the plant. These oscillations are, however, undesirable also from an energy standpoint.

There are involved self-excited acoustic oscillations of the gases in the combustion chamber and in the pipelines which feed the combustion air as well as the fuel gas. In practice, these detrimental oscillations are generally controlled purely empirically by more or less systematic changes in the geometry of the burner or by variation of the composition of the fuel gas. This generally leads to unsatisfactory results and practically always to compromises in which undesired disadvantages must be tolerated.

In German Pat. No. 23 50 338 there is disclosed a device for the avoidance of combustion-chamber oscillations. Within the gas feed is incorporated a hollow space as a reflection chamber which has a spacing of one-quarter acoustic wavelength from the burner mouth at that natural frequency of the combustion chamber at which self-excitation is to be expected or feared. This device has proven itself excellent in many blast heater installations which are originally equipped with these reflection chambers. The reflection chambers provide the desired result. Even in case of strong variation of the composition of the fuel gas, no oscillations were observed. However, with this device it is necessary that the critical natural frequency be precisely calculated in advance before the plant is constructed, which sometimes is difficult. In addition to this, the device is to be arranged outside the combustion chamber, which means that additional space is required. The subsequent incorporation of such reflection chamber frequently encounters considerable difficulties, at least in the case of large installations, since structural space is then necessary, for the creating of which other parts of the plant frequently have to be shifted to another place.

SUMMARY OF THE INVENTION

The present invention avoids these drawbacks. It is the object of the invention to create a space-saving possibility of avoiding combustion-chamber oscillations, which possibility is substantially independent of frequency and therefore does not require any precise prior calculation, and which furthermore can easily be added subsequently in existing combustion chambers.

The invention resides in the fact that a body is coupled with the acoustic oscillation of the gases in the combustion chamber and the oscillation of this body is dampened. In this way the result is obtained that self-excited oscillations cannot come about, since the dampening of this body does not reduce the amplitude of a self-excited oscillation by a certain amount but rather does not permit a self-excited oscillation to come into existence.

In accordance with the invention, the combustion chamber is constructed in such a manner that at least one wall of the combustion chamber, or a part of a wall, is provided or coupled with an oscillation dampener.

In this connection, the wall of the combustion chamber or a part of it can already be provided or coupled with an oscillation dampener at the time of manufacture, but such a wall can also be installed subsequently into the combustion chamber by placing it, for instance, within the combustion chamber in front of one wall of the combustion chamber. Such a wall does not even permit self-excited oscillation to occur.

In accordance with the invention, the oscillatable wall of the combustion chamber is coupled with a dissipative mass, with a hydraulic dashpot and/or with a dampened mechanical resonator consisting of a spring and mass and/or is provided with a dampening layer. As a spring there can be used a steel spring, a rubber spring, or else a spring consisting of some other vibration absorbing material.

In order to make the action of such a wall of the combustion chamber particularly suitable for the dampening of mechanical osicllations, it is advisable to construct this wall of the combustion chamber which is to be dampened of low flexural rigidity. In such case it is easy to place it into oscillations which can be effectively dampened by the damping means provided so that the combustion chamber oscillations are effectively suppressed.

Alternatively one can use a flexurally rigid plate which is connected at its edge elastically but hermetically, for instance by folded bellows of metal or by a strip of flexurally soft material, with the fixed wall of the combustion chamber. The plate can be excited by the alternating pressure into piston-like oscillations which are to be dampened in order to avoid oscillations of the combustion chamber. The flexurally rigid plate can either be introduced into the outer wall of the combustion chamber or be placed within the combustion chamber in front of the outer wall. This flexurally soft edge strip can be made flexurally soft, for instance by creases similar to the edge attachment of the diaphragm of a loudspeaker.

The flexibly soft wall and the elastically suspended plate suppress combustion chamber oscillations most effectively if they are arranged at a spatial maximum of the alternating pressure distribution within the combustion chamber.

Since in many cases it is desirable to use vibration absorbing masses which contain rubber, caoutchouc, tar products or the like and therefore heat-sensitive substances, it is advisable for the oscillatable wall to be cooled or to be traversed by a coolant. The damping means are in general arranged on that side of the wall which faces the fire. By the cooling, the result is then obtained that high temperatures prevail on the side of the wall facing the fire while on the side of the wall facing away from the fire there are present only temperatures at which the vibration absorbing masses consisting of rubber, caouchouc, and/or tar products are not damaged by the action of heat.

Upon the subsequent installation of such a combustion chamber wall provided or coupled with an oscillation dampener, the wall of low flexural rigidity or rigid wall flexibly fastened at its edge, which is provided with an oscillation dampener, is preferably arranged in front of a flexurally stiff wall of the combustion chamber.

DESCRIPTION OF THE INVENTION

The essence of the invention will be explained in further detail below:

Combustion-chamber oscillations are primarily oscillations of pressure and velocity of the gases in the combustion chamber. These oscillations could exist even if the walls of the combustion chamber were completely rigid, i.e. ideally reverberant. In practice, however, the walls are not completely rigid. They are therefore excited into mechanical oscillations by the oscillation of the gas pressure. Together with the wall parts, other parts of the plant such as uprights or braces also move.

In accordance with the invention, the movement of a wall part or a part of the plant is dampened by dampening devices. In this way power is removed from the oscillation of pressure and velocity of the gases in the combustion chamber. It may be expressly pointed out that the dampening devices do not have the purpose of reducing the amplitudes of self-excited oscillations by a given amount but rather are intended to completely eliminate the self-excited oscillations. In order to designate them by the manner of action, the damping devices will be referred to as self-excitation blockers.

As self-excitation blockers there are suitable in principle all dampers for mechanical oscillations known in industry. In each individual case, however, it is necessary to decide with what type of damper one can best achieve the goal of withdrawing as much power as possible from the pressure oscillation in the combustion chamber by the coupled damped oscillating body.

In the following, four different types of self-excitation blockers will be described. In this connection, it will be assumed in all cases that one of the walls of the combustion chamber is excited strongly to oscillation if self-excited oscillations occur.

The first example of a self-excitation blocker consists of a cavity which is filled with a granular material such as sand and is rigidly connected at a point of maximum amplitude of movement with the oscillatable wall (see Kurtze, Schmidt, Westphal: Physik and Technik der Larmbekampfung, Braun, 1972 pages 193 to 199. The losses are produced by internal friction in the granular substance which participates in the movement.

A second type of self-excitation blocker consists of a hydraulic dashpot which is arranged between a point of maximum amplitude of oscillation on the wall and a quiescent point not participating in the oscillation.

The third self-excitation blocker consists of a dampening layer with which the wall capable of flexural oscillations is covered. Such damping layers are known in the art of noise control for the dampening of sound conducted through solids and are there referred to as anti-noise layers. Both homogeneous damping layers and sandwich layers are suitable as self-excitation blockers.

A fourth type of self-excitation blocker consists of a mechanical resonator, consisting of a vibration absorbing spring, for instance of rubber, and a mass placed thereon ("sound absorber") which is coupled to the wall at the point of maximum movement. The wall oscillation is selectively dampened at the natural frequency of the imposed mechanical resonator.

A prerequisite for the effectiveness of the self-excitation blockers is that they be arranged on a wall of the combustion chamber which also oscillates in the event of oscillations of the combustion chamber. If such a wall is not already present, one of the walls must intentionally be made flexurally soft or else rigid with a flexurally soft edge, so that it can also oscillate. Advantages Obtainable:

Self-excitation blockers in accordance with the invention can in most cases be attached subsequently without cumbersome conversion work. There are various types of self-excitation blockers available, from which the one most favorable in each case can be selected. The parameters of the self-excitation blockers can be varied in a relatively simple manner and adapted to the requirements of the individual case. The self-excitation blockers of the "vibration absorbing mass," "dashpot" and "anti-noise layer" type are effective over a broad band so that the danger of self-excitation of higher natural frequencies is reduced.

BRIEF DESCRIPTION OF DRAWINGS

Illustrative embodiments are shown diagrammatically in the drawings, in which.

All figures are schematic sectional views.

DESCRIPTION OF PREFERRED EMBODIMENTS

Figure 1:
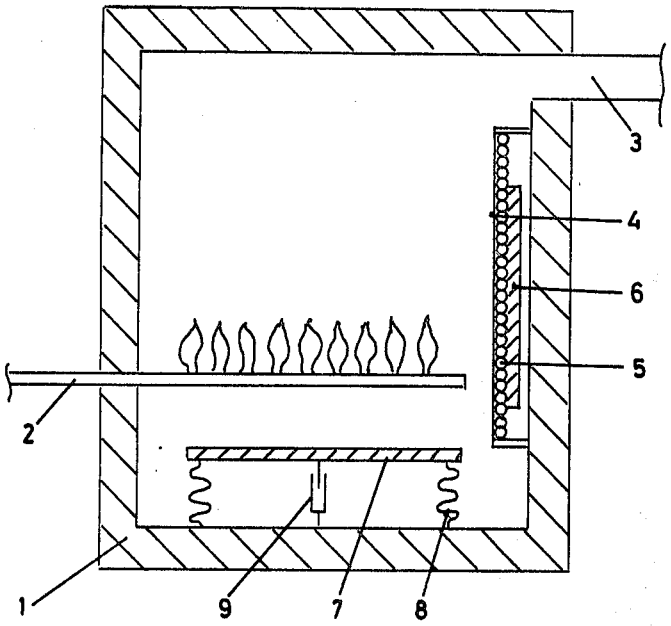
FIG. 1 shows a combustion chamber having a subsequently installed damped flexurally soft wall as well as a subsequently installed damped rigid wall softly suspended at its edge.

The combustion chamber of FIG. 1 comprises a casing 1 which is made of cast iron and has a burner 2 as well as an outlet 3. The walls of this casing which consist of cast iron are flexurally very rigid. If oscillations develop in such a burner, they can be avoided by installing within the casing 1 a flexurally soft plate 4, which forms one wall of the space in the combustion chamber in which combustion occurs. The plate 4 is for instance a plate of sheetmetal of a thickness of 1 to 3 mm. which is connected at its edge rigidly and in pressure-tight fashion with the wall of the casing 1 and on the rear of which a vibration absorbing mass is arranged. The flexurally soft wall 4 is arranged in front of the rear wall of the casing 1. It is advisedly provided with a pipe coil 5 soldered thereon so that it can be cooled. Between the flexurally soft plate 4 having the pipe coil 5 and the rear wall of the casing 1 a vibration absorbing mass 6 is arranged on the plate 4. In this embodiment there is furthermore provided above the bottom of the casing 1 a flexurally rigid plate 7 which is connected at its edge by a folded bellows 8 of sheet metal in pressure-tight manner with the bottom of the casing 1 and forms a bottom wall of the space in the combustion chamber in which combustion occurs. In certain cases the plate 7 need not be provided with cooling since the combustion air fed to the burner flows over this plate and effects a cooling. Between the oscillatable plate 7 and the bottom of the casing 1 a hydraulic dashpot 9 is arranged. These oscillatable walls 4, 7 of the combustion chamber can easily be installed subsequently in a pre-existing casing 1. If sufficiently dimensioned, they reliably avoid the excitation of combustion-chamber oscillations.

Figure 2:
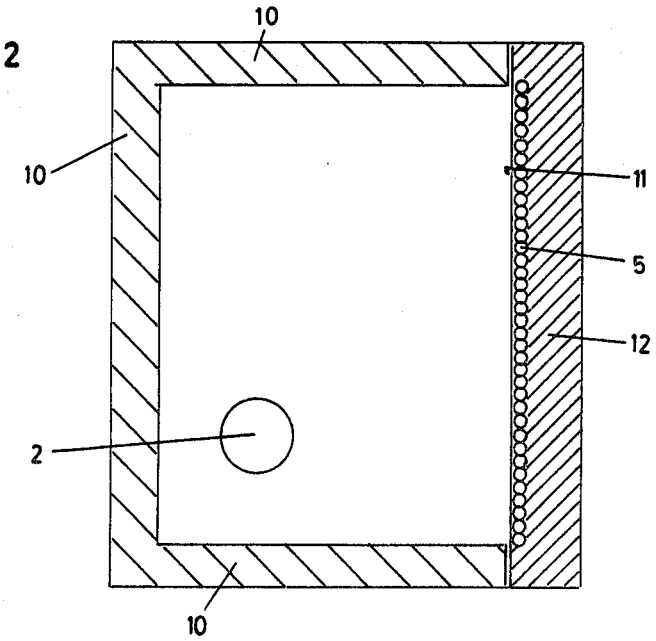
FIG. 2 shows a combustion chamber having a flexurally soft outer wall which is damped by application of a high-loss mass.

In the embodiment shown in FIG. 2, the parallelepipedshaped combustion chamber has five rigid walls 10 and one flexurally soft wall 11. The burner 2 is arranged in the one end of the combustion chamber and the outlet for the burned gases in the other end. The flexurally soft wall 11 is cooled by a cooling coil 5 soldered thereon and is coated on the outer side with vibration absorbing composition 12 which consists of a mixture of rubber, tar products and plastics. Due to the cooling by the cooling coil 5, this composition 12 only reaches such a temperature that no decomposition occurs.

Figure 3:
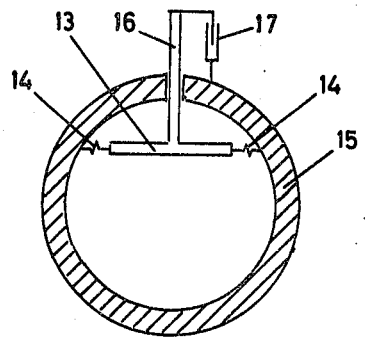
FIG. 3 shows a cylindrical combustion chamber having an oscillatable rigid plate on the inside which is connected with the rigid combustion-chamber wall elastically at the edge by a thin plate provided with creases and the movement of which is transmitted by a rod into the outer space and damped there by a hydraulic dashpot.

The cylindrical casing of the combustion chamber of FIG. 3 contains a rigid plate 13 which is connected at the edge with the rigid casing wall 15 by a thin sheet metal strip 14 provided with creases and forms a chord-like wall of an otherwise cylindrical combustion chamber. By a bar 16 firmly connected to the plate 13 the oscillation of the plate 13, is transmitted into the space outside the combustion chamber casing. Between the end of the bar 16 and the casing wall 15, a hydraulic dashpot 17 is arranged on the outside.

Figure 4:
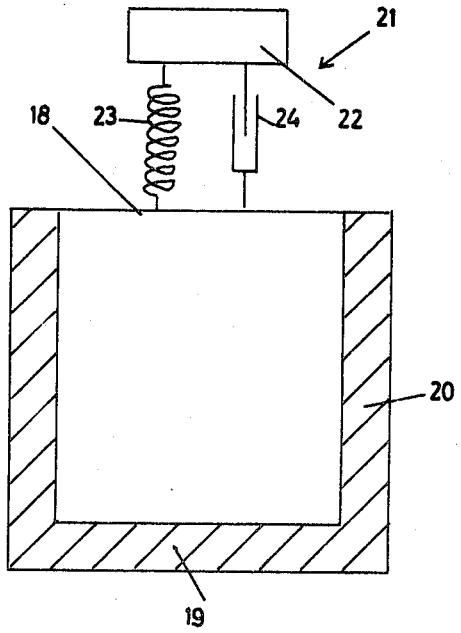
FIG. 4 shows combustion chamber with a flexurally soft cover the movement of which is damped by a coupled sound absorber.

In the case of the combustion chamber of FIG. 4, the upper wall 18 of the combustion chamber is flexurally softer than the bottom 19 and the side walls 20 so that upon the occurrence of combustion chamber oscillations it also oscillates. At the point of maximum movement of the wall 18, there is fastened a sound absorber 21 consisting of mass 22, a steel spring 23 and hydraulic dashpot 24. The natural frequency of the sound absorber 21 is tuned to the frequency of the self-excited oscillation which is to be suppressed.

What is claimed is:

1. In a device for the combustion of fuel gases and liquid, powdered or particulate fuels, comprising a combustion chamber, means for delivering a fuel-air mixture to said combustion chamber for combustion of said fuel therein, and an outlet for the burned gases, the improvement for avoiding sonic and and subsonic oscillation of gases in the combustion chamber which consists in that said combustion chamber comprises a casing having a rigid walls, and that an oscillation plate spaced inwardly of a wall of said casing with its peripheral edge hermetically connected to the casing wall is oscillatable by oscillations occurring in said combustion chamber, and means associated with said plate is provided for damping oscillation of said oscillatable plate.

2. A device according to claim 1, in which said oscillatable plate is flexurally rigid and in which the peripheral edge of said oscillatable plate is connected in a pressure-tight manner with a casing wall by sheet metal bellows.

3. A device according to claim 1, in which means for damping oscillation of said oscillatable plate comprises damping means coupled between said oscillatable plate and a wall of said casing.

4. A device according to claim 1, in which means for damping oscillation of said oscillatable plate comprises a hydraulic dashpot coupled between said oscillatable plate and a fixed support.

5. A device according to claim 1 in which said oscillatable plate is flexible and is rigidly connected at its peripheral edge in a pressure-tight manner with a wall of said casing.

6. A device according to claim 5, in which said means for damping oscillation comprises a vibration absorbing composition affixed on the side of said oscillatable plate which faces said casing wall.

7. A device according to claim 6, in which a cooling coil is interposed between said oscillatable plate and said vibration absorbing composition.

8. A method of avoiding oscillations in a combustion chamber to which a mixture of fuel and air is delivered and in which the fuel-air mixture is burned, said method comprising mounting in said combustion chamber an oscillatable plate spaced inwardly of a wall of the combustion chamber with its peripheral edge hermetically connected with a chamber wall, said plate being oscillatable by oscillations occurring in the combustion chamber and providing means associated with said oscillatable plate for damping oscillation of said oscillatable plate.

* * * * *